US005402697A

United States Patent [19]

Brooks

[11] Patent Number: 5,402,697

[45] Date of Patent: Apr. 4, 1995

[54] DEPILATORY APPLICATING RAZOR

[76] Inventor: Shirley E. Brooks, 120 Holland Ct., Middletown, Del. 19709

[21] Appl. No.: 154,110

[22] Filed: Nov. 18, 1993

[51] Int. Cl.[6] ..... B26B 21/44

[52] U.S. Cl. ..... 83/18; 30/34.2; 30/41

[58] Field of Search ..... 30/41, 41.5, 86, 34.2; 83/18

[56] References Cited

U.S. PATENT DOCUMENTS

| | | | |
|---|---|---|---|
| 2,548,959 | 4/1951 | Eisenberg et al. | 30/34.2 |
| 2,766,521 | 10/1956 | Benvenuti | 30/34.2 |
| 3,103,299 | 9/1963 | Werft | 30/41 X |
| 3,686,296 | 8/1972 | Yablonsky | 260/534 S |
| 3,726,009 | 4/1973 | Hackmyer | 30/41 |
| 3,865,546 | 2/1975 | Zemlin et al. | 8/161 |
| 3,871,073 | 3/1975 | Nissen et al. | 30/34.2 |
| 4,044,463 | 8/1977 | Thetjens | 30/34.2 |
| 4,121,904 | 10/1978 | Schamper | 8/161 |
| 4,250,617 | 2/1981 | Bakker et al. | 30/34.2 |
| 4,490,906 | 1/1985 | Haes et al. | 30/34.2 |
| 4,490,907 | 1/1985 | Benedictus | 30/34.2 |
| 4,510,687 | 4/1985 | Groothuis et al. | 30/34.2 |
| 4,618,344 | 10/1986 | Wells | 8/161 |
| 4,631,064 | 12/1986 | Juneja | 8/161 |
| 4,734,099 | 3/1988 | Cyprien | 8/160 |
| 4,760,642 | 8/1988 | Kwak | 30/41 X |
| 4,830,633 | 5/1989 | Hori et al. | 8/160 |
| 4,832,949 | 4/1989 | Royal | 424/73 |
| 4,842,610 | 6/1989 | Gordon et al. | 8/160 |
| 4,845,846 | 7/1989 | Sinka | 30/34.2 |
| 4,847,995 | 7/1989 | Savenue | 30/34.2 |
| 4,896,420 | 1/1990 | Locke | 30/34.2 |
| 4,998,347 | 3/1991 | Schachter | 30/34.2 |
| 5,014,427 | 5/1991 | Byrne | 30/41 |
| 5,067,238 | 11/1991 | Miller et al. | 30/34.2 |

*Primary Examiner*—Richard K. Seidel
*Assistant Examiner*—Raymond D. Woods
*Attorney, Agent, or Firm*—Connolly & Hutz

[57] ABSTRACT

A depilatory applicating razor includes a handle with a cutting head mounted to the handle. The cutting head includes at least one cutting blade. The cutting head also includes a depilatory applicator through which a depilatory substance may be discharged in the general area of the cutting blade.

26 Claims, 3 Drawing Sheets

DEPILATORY APPLICATING RAZOR

BACKGROUND OF THE INVENTION

Various approaches have been taken to provide an optimum manner of shaving. One conventional approach is by the use of a razor. The razor may take the form of a manual razor which has a single edge or multiple edge blades or may be an electric razor having cutting heads. In order to increase the effectiveness of the cutting action it has been suggested to provide such razors with skin tensioning means so as to provide a closer shave.

A distinctly different approach from the razors is to utilize the chemical action of a depilatory substance. In conventional practices this involves applying the depilatory substance to the skin. The substance remains on the skin where it chemically attacks the hair. After a predetermined period of time the substance is wiped from the skin to remove the hair which had been in contact with the substance.

While the above approaches have had varying degrees of success there is still a desire to maximize the effectiveness of hair removal without detrimentally affecting the convenience of operation.

SUMMARY OF THE INVENTION

An object of this invention is to provide shaving techniques which meet the above needs by combining the actions of a razor with the actions of a depilatory.

A further object of this invention is to provide such techniques wherein a depilatory is applied to the skin through the head of a razor while the razor is performing its cutting action.

In accordance with this invention the razor includes a handle portion which would be held by the user. A cutting head is mounted to the handle for being placed against the skin. The cutting head includes at least one cutting blade for performing the shaving or cutting action. The cutting head additionally includes a depilatory discharge spout through which a depilatory substance would be discharged against the skin.

In the preferred practice of the invention the depilatory substance is discharged in the general area of the cutting blade for reaching that area generally simultaneously or shortly after the blade has cut the hair. The invention is preferably practiced by having the depilatory substance located in a reservoir in the handle.

The invention is preferably practiced by incorporating skin tensioning means on the cutting head to stretch the skin during the cutting action so that the depilatory may more readily enter the pores which are exposed by the stretched or tensioned skin. The invention may be practiced by having the user control the discharge in manners customarily used for applying shaving cream from razors having shaving cream reservoirs. Alternatively, particularly where skin tensioning rollers are used, the tensioning rollers may be interconnected with the depilatory reservoir for discharging the depilatory in response to movement of the rollers.

THE DRAWINGS

DETAILED DESCRIPTION

Figure 1:
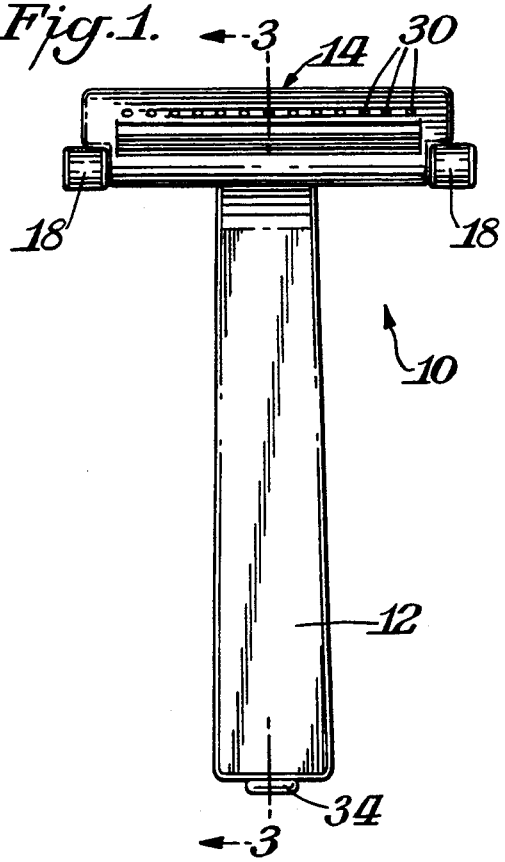
FIG. 1 is a front elevational view of a depilatory applicating razor in accordance with one embodiment of this invention.

The present invention is generally based upon the concept of providing a razor with a supply of flowable substance so that the flowable substance can be applied to the skin by the same razor which is performing a mechanical action. In the preferred practice of the invention, the substance is a depilatory substance which is discharged from the cutting head of the razor. The razor may take any known form, such as a single edge razor, a double edge razor, a disposable manual razor, a reusable manual razor or an electric razor. The invention may also be practiced where the reservoir for the depilatory substance and the dispensing spout take any suitable form. In the preferred practice of the invention the depilatory substance would be discharged through the cutting head so that the depilatory substance is discharged in the general area of the cutting action. Where the razor includes known skin stretching or tensioning devices it is preferred to apply the depilatory substance at the areas of the skin being stretched so as to facilitate the depilatory substance entering the pores. The depilatory substance may subsequently be removed in a known manner such as by wiping the substance from the skin. The invention may be practiced for razors used at any part of the body including, the face, legs, underarms, etc.

In its broad aspect the invention could be practiced using flowable substance other than depilatory substances. Such substances could be used instead of or added to the depilatory substance. Such other substances could be medicaments or could be lotions particularly after shave lotions, baby lotions, moistening lotions and other lotions. Note is made that U.S. Pat. No. 5,121,541 discloses an electric razor which applies a lubricating agent in the form of a misting. This differs from the present invention even where the present invention is practiced with substances other than depilatories. With the present invention such lotions are applied with low cost manual razors. In addition by applying the substances from a manual razor, the flow of the substance could be directed to be only upstream from the shaving action. Such control of flow location is more difficult with the normal shaving action or electric razors where it is common to run the razor over the same area a number of times.

FIGS. 1–4 illustrate a razor 10 in accordance with one embodiment of this invention. As shown therein razor 10 is a single edge razor in the sense that the blades extend from only one edge of the razor. As illustrated, razor 10 includes a handle 12 which would be gripped by the user. A cutting head 14 is mounted to one end of the handle. Cutting head 14 includes a pair of cutting blades 16, 16. It is to be understood that the illustrated number of cutting blades is for exemplary purposes only. A single blade or more than two blades could be used.

In the illustrated embodiment, razor 10 is a disposable razor which is intended to be discarded after a single or limited number of uses. It is possible of course to practice the invention where the razor is of a more permanent type intended to have a large number of uses. This can be accomplished by having, for example, a detachable head 14A which is later described with respect to FIG. 9.

Figure 2:
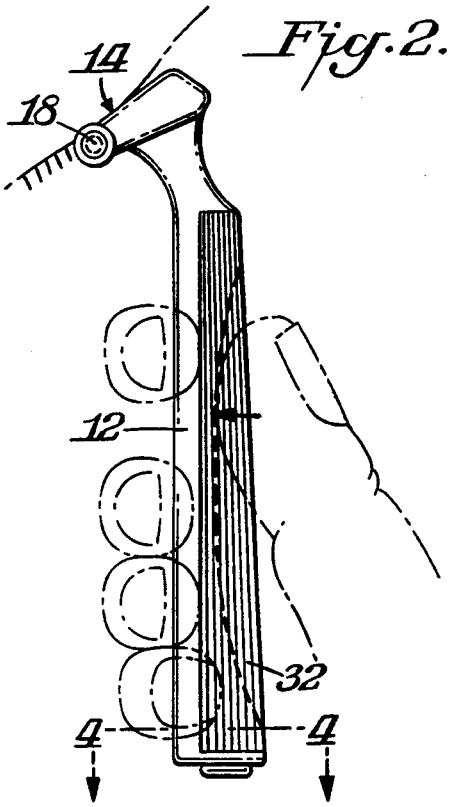
FIG. 2 is a side elevational view of the razor shown in FIG. 1.
Figure 3:
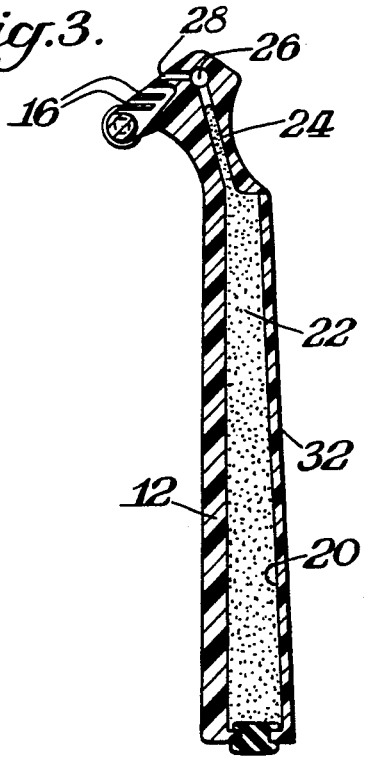
FIG. 3 is a cross-sectional view taken through FIG. 1 along the line 3—3.

FIGS. 1–3 also illustrate a particularly useful practice of the invention wherein skin tensioning rollers 18 are mounted on cutting head 14. The skin tensioning means need not be in roller form but could take the form of any known skin tensioning devices. Such exemplary devices are shown and described in U.S. Pat. Nos. 4,845,846; 4,044,463; 5,067,238; 4,998,347; and 4,847,995 all of which relate to single edge razors and the details of which are incorporated herein by reference thereto. Suitable skin tensioning or skin stretching techniques are also described in U.S. Pat. Nos. 2,766,521; 2,548,959; and 3,871,073 which relate to double edge razors and the details of which are incorporated herein. It is to be understood that although the various figures, namely FIGS. 1–9, relating to manual single edge razors, the invention may be practiced with double edge razors which would be of generally known construction, but would incorporate techniques for applying a depilatory. The double edge razors may also incorporate various skin stretching or skin tensioning means.

Figure 4:
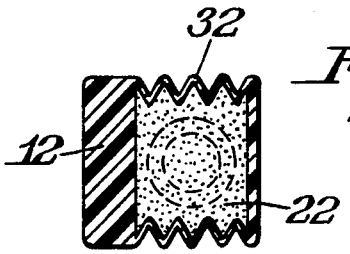
FIG. 4 is a cross-sectional view taken through FIG. 2 along the line 4—4.

FIGS. 2–4 illustrate the handle 12 to include a reservoir 20 in which is a supply of depilatory substance 22. Reservoir 20 leads to a supply passage 24 which terminates at elongated manifolds 26 of a length to extend substantially the entire length of the cutting head 14. In the embodiment illustrated in FIGS. 1 and 3 a series of individual discharge passages 28 lead outwardly from manifold 26 and terminate in discharge ports 30 which extend across the length of cutting head 14.

Figure 8:
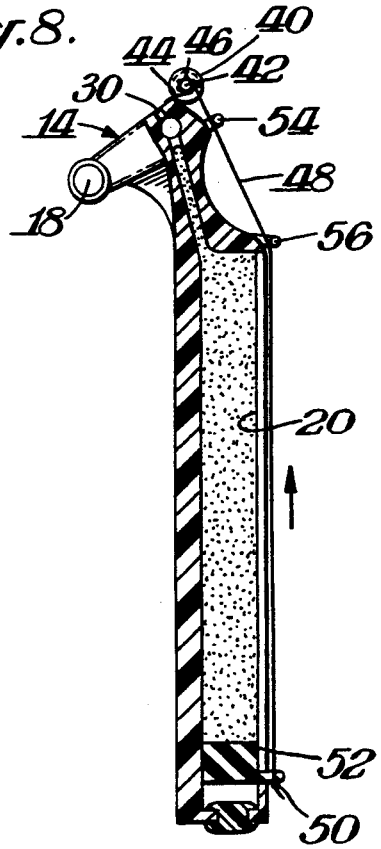
FIG. 8 is a cross-sectional view taken through FIG. 7 along the line 8—8.

In practice, while the razor 10 would be used to cut hair from the skin by means of blades 16, a depilatory 22 would be simultaneously discharged through ports 30 onto the skin. In the preferred practice of the invention passages 28 are angled toward blades 16, 16, so that the ports 30 are positioned so as to discharge the depilatory slightly upstream from the cutting action at a location where the skin tensioning means 18 still maintains the skin in a stretched condition. Thus, the depilatory may enter the exposed pores in the manner shown in FIG. 2. If desired passage 28 could be angled more upstream of blades 16, 16 (as shown in FIG. 8) or could be angled downstream from the blades. It is preferred to direct the depilatory substance as close as possible to but upstream from the blades to maximize the amount of depilatory substance entering the pores.

The invention may be practiced by using any suitable means for discharging the depilatory from the razor onto the skin. Suitable means may include known techniques which have been used for applying shaving cream mounted in reservoirs of a razor such as exemplified by U.S. Pat. Nos. 4,635,361; 4,716,652; 5,121,541; 4,800,649; 5,014,427; and 5,092,041 the details of which are incorporated herein by reference thereto.

FIGS. 2 and 4 illustrate for exemplary purposes one manner of applying the depilatory to the skin. As shown therein a portion of handle 12 which contains the depilatory reservoir 20 is made as a diaphragm having an accordion type squeeze structure 32. Thus, the user could control the application of the depilatory by squeezing handle 12 to collapse the accordion structure 32 thereby forcing depilatory substance 22 to flow through channel 24, into manifold 26, then into individual passages 28, and ultimately exit from ports 30. As illustrated a plug 34 closes the end of reservoir 20 to seal the reservoir after substance 22 has been inserted. Plug 34 may be removable to permit a fresh supply of substance 22 to be added as desired. Alternatively, plug 34 may be permanently mounted to the end of reservoir 20 after the initial supply of substance 22 has been placed in reservoir 20.

Figure 5:
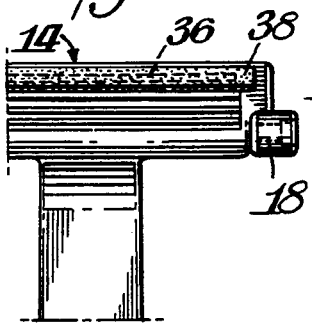
FIG. 5 is a fragmental front elevational view of an alternative form of razor in accordance with this invention.
Figure 6:
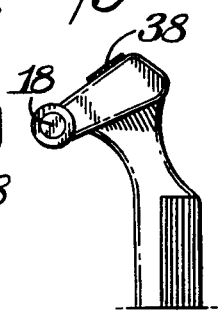
FIG. 6 is a side elevational view of the razor shown in FIG. 5.

FIGS. 5–6 illustrate an alternative form of discharge means for the depilatory. As shown therein instead of having a plurality of individual ports 30, a single elongated slot 36 extends across cutting head 14. Slot 36 would communicate directly with the manifold such as manifold 26 of FIG. 3. If desired, a sheet or pad of foam material 38 may be placed at the exposed end of slot 36 so that the depilatory substance 22 would saturate foam pad 38 as the depilatory substance is discharged through slot 36. The saturated foam pad 38 would then contact the skin for applying the depilatory substance 22.

Figure 7:
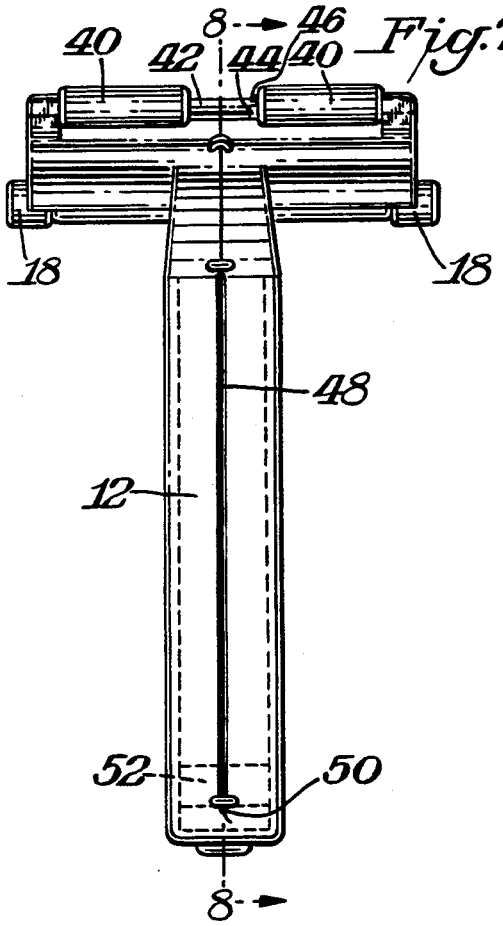
FIG. 7 is a rear elevational view of still yet another form of razor in accordance with this invention.

The depilatory substance could be conveyed to the outlet ports or slot in any suitable manner such as by the diaphragm or squeeze structure 32 illustrated in FIGS. 2 and 4. Structures of this type would have the degree of application of the depilatory substance dependent on user action. Thus, the user could control the amount of flow by the amount of squeezing of the diaphragm or accordion type wall 32. FIGS. 7–8 illustrate an alternative form of depilatory type application which is controlled in response to use of the razor rather than under direct control by the user controlling the squeezing force or pressure during use of the razor.

As shown in FIGS. 7–8 a set of skin tensioning rollers 18 is provided at the ends of cutting head 14. A second set of rollers 40 is also provided on cutting head 14. The rollers 40 are mounted on a shaft 42 in any suitable manner. In the illustrated form a pawl 44 secured to one of the rollers 40 engages ratchet teeth 46 on shaft 42 for one-way movement. An actuating member 48 is anchored at one end to shaft 42. Actuating member 48 may be made of any suitable material such as a plastic or metal wire or string. The opposite end 50 of actuating member 48 is anchored to piston head 52 at the bottom of reservoir 20. As rollers 40 rotate during the shaving action the inter-engagement of the ratchet 46 and pawl 44 causes shaft 42 to rotate. The rotation of shaft 42 is transmitted by actuating member 48 to piston head 52 for moving the piston head upwardly in reservoir 20 and thus force the depilatory substance 22 out of discharge ports 30 in the manner previously described. Use of the ratchet and pawl arrangement assures only one way movement of piston head 52, namely in the dispensing direction. A series of guides 54, 56 is provided on head 14 and handle 12 through which actuating member 48 would extend.

Figure 9:
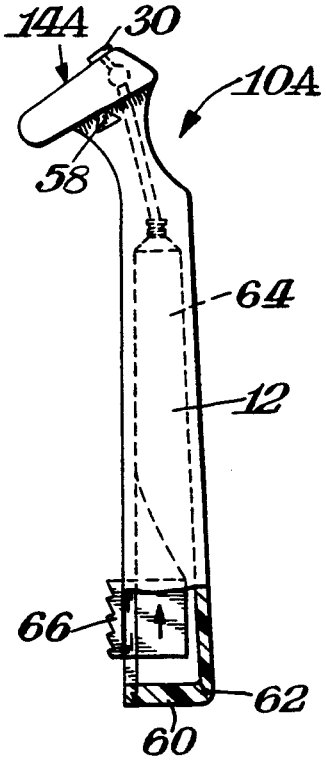
FIG. 9 is a side elevational view of still yet another razor in accordance with this invention.

The embodiments of FIGS. 1–8 are generally directed to the disposable razor techniques. FIG. 9 shows a variation which is intended to be used with a permanent type razor. Generally, such permanent type razors include detachable heads which may be replaced when the blade begins to get dull. Any known means may be used for detachably mounting the head to the handle. FIG. 9, for example, illustrates a detachable head 14A mounted to handle 12 by a dovetail connection 58.

Since razor 10A of FIG. 9 is intended to be reusable a large number of times it might be necessary to provide some means for periodically replenishing the supply of depilatory. This may be done in any suitable manner. FIG. 9, for example, shows the lower end 60 of handle 12 to be connected by a hinge 62 to the main body portion of handle 12 so that the lower end could be opened and thus provide access to the hollow interior of handle 12. The reservoir 64 for the depilatory substance could be of tube form which may be replaced. Reference is made, for example, to U.S. Pat. No. 4,635,361 which illustrates such a technique being used for supplying shaving lotion. The details of that patent are incorporated herein by reference thereto. Those techniques are utilized in the razor 10A by incorporating a slide actuator 66 which would be pushed by the user for dispensing the depilatory substance from tube 64 during use of the razor 10A.

As previously noted, the invention may be used with double edge razors having exposed blade edges on opposite edges of the cutting head. With double edge razors, the depilatory dispensing port or ports could be directed closer toward one of the edges or to an area an equal distance between both edges. Alternatively, the dispensing port or ports could be in a block pivotally mounted to the cutting head whereby the user could rotate the block until the ports are parallel with the edges and then lock the block in that position. The rotation option would permit the user to selectively direct the ports and to discharge depilatory toward whatever cutting edge is being used.

Figure 10:
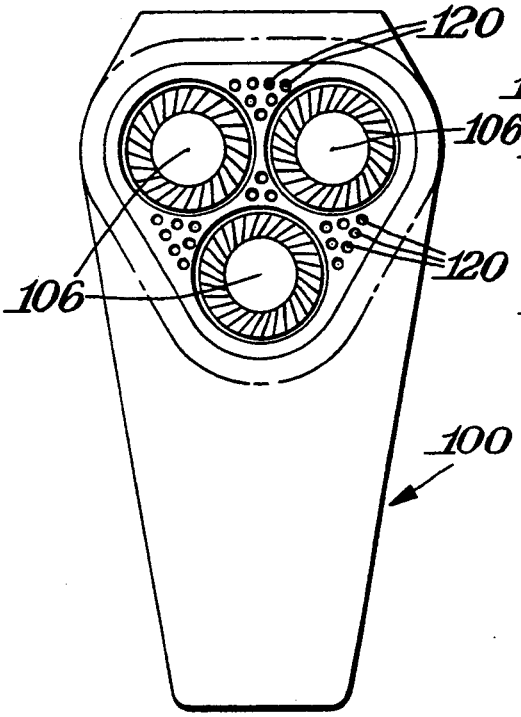
FIG. 10 is a front elevational view of an electric razor which is a further practice of this invention.
Figure 11:
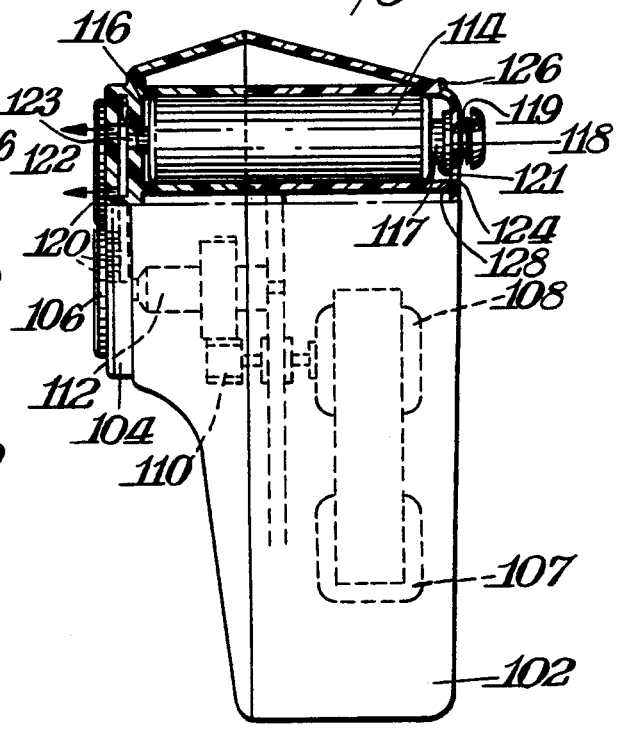
FIG. 11 is a fragmental side elevational view partly in section of the razor shown in FIG. 10.
Figure 12:
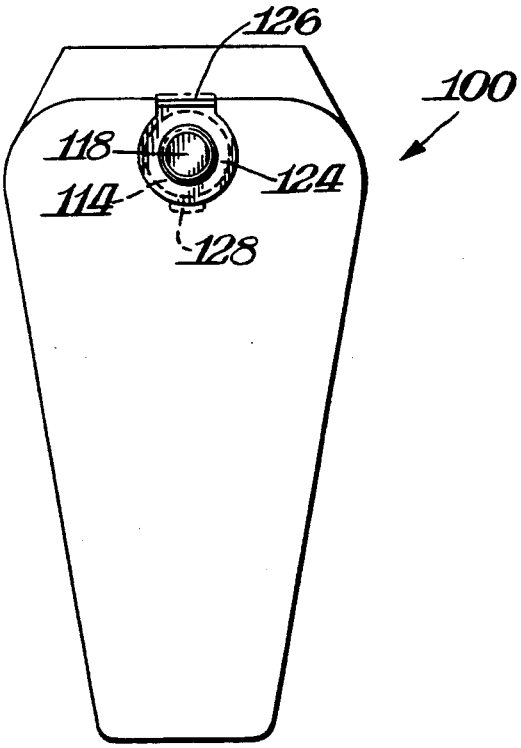
FIG. 12 is a rear elevational view of the razor shown in FIGS. 10–11.

FIGS. 10–12 illustrate the concepts of this invention being applied to electric razors. FIGS. 10–12 illustrate an electric razor 100 which could be utilized for practicing this invention. Reference is made to U.S. Pat. Nos. 4,490,907; 4,490,906; 4,250,617; and 4,510,687 the details of which are incorporated herein by reference thereto with respect to electric razors having skin stretching means. For illustrative purposes device 100 is generally formed along the lines of U.S. Pat. No. 4,490,907. Device 100 thus includes a handle section 102 and an offset shaving head 104 which includes a number of individual shaving units 106, each of which would incorporate skin stretching elements in the manner described in U.S. Pat. No. 4,490,907. Handle 102 houses a motor 107 having a drive 108 suitably connected to drive gear 110 which in turn drives shaft 112 for rotating the cutting units 106.

In order to incorporate the techniques of this invention razor 100 includes some means for applying a depilatory in the general area of the cutting action. FIGS. 10–12 illustrate one suitable means. As shown therein an aerosol dispenser 114 is mounted in handle 102. The outlet 116 of dispenser 114 extends into cutting head 104.

Flow through outlet 116 would result in the depilatory within aerosol container 114 being expelled through an opening or hole 123 which leads to manifold 122. From there the depilatory would be expelled through passages terminating in discharge ports 120 located at the outer surface of the cutting head, as best shown in FIG. 10.

In order to actuate outlet nozzle 116 it is necessary to create a relative inward movement of the nozzle 116 with respect to the main body of dispenser 114. This is accomplished by an actuating arrangement best shown in FIG. 11. As shown therein, nozzle 116 is mounted in a shoulder of the wall having the outlet opening or hole 123. Dispenser 114 could be spring biased in a direction away from the hole 123 so that ordinarily outlet or nozzle 116 remains in the extended or non-depressed condition. In order to depress nozzle 116 a movement is imparted to dispenser 114 in a direction toward hole 123. Because nozzle 116 is mounted in the recess or shoulder, nozzle 116 can not move, thus a movement of dispenser 114 results in a movement which is in effect an inward depression of nozzle 116 so that the aerosol dispenser 114 expels its contents in the normal manner with aerosol containers.

FIG. 11 also shows a technique for causing relative movement of dispenser 114. As shown therein an actuator or push button 118 is mounted externally of handle 102. An actuator block 117 is mounted at the opposite end of button 118 and is disposed in contact with the rear wall of aerosol dispenser 114. A spring 119 urges button 118 outwardly. Thus, under ordinary conditions button 118 is urged outwardly and dispenser 114 is urged away from hole 123 so that there is no depression of nozzle 116 into dispenser 114. The outward movement of button 118 is limited by an annular flange or stop member 121 which abuts against the wall of handle 122. When it is desired to actuate dispenser 114 button 118 is moved inwardly to overcome the action of spring 119 so that actuator block 117 pushes dispenser 114 toward the shaving units 106. Since nozzle 116 is prevented from moving along with dispenser 114 by virtue of nozzle 116 being seated in the recess of the wall having opening 123, the movement of dispenser 114 results in actuation of nozzle 116 to expel the depilatory from dispenser 114 and be discharged through ports 120 in the manner previously described.

In order to provide access to the interior of razor 100 for replacing dispenser 114 a cover 124 is mounted by a hinge 126 to the upper portion of handle 102. A latch 128 is provided to selectively maintain cover 124 in a closed position and selectively permit the fill cover 124 to be opened so that a used dispenser 114 could be removed and a new dispenser replaced.

It is to be understood that the invention may be practiced in a broad aspect by simply applying depilatory to the skin by means of a razor. The location of application could be directly at the cutting blades or upstream from or downstream from the cutting blades. In the preferred practice of the invention the application is made generally at or slightly upstream from the cutting action so that the depilatory remains on the skin and is not removed by the cutting action. The invention is preferably practiced where the razor includes some skin stretching or tensioning means so that the depilatory could be applied directly into the exposed pores.

The depilatory substance 22 may also include other substances which would be desired for being applied to the skin, particularly during a shaving operation. Such other substances are, for example, various lotions or medicaments, as previously noted. These other substances could be applied along with or instead of the depilatory substance.

Any suitable depilatory may be used in the practice of the invention. Reference is made to U.S. Pat. Nos. 3,865,546; 4,830,633; 4,618,344; 4,842,610; 4,631,064; 4,121,904; 4,832,949; and 4,734,099 the details of which are incorporated herein by reference thereto. In the known techniques for utilizing a depilatory for the removal of unwanted hair, the depilatory is spread on the skin and remains on the skin for a preset period of time which is generally about 10 minutes. Various of the above noted patents, however, disclose depilatories which would be operative in a much lesser period of time including as little as one minute. Because the depilatories could be applied directly into the exposed pores it is expected that the depilatory action, by practice of the invention, would require even less time. Where a depilatory substance is used which requires a set period of time for the chemical action to take place, the invention would be practiced by applying the depilatory at a location on the skin upstream from where the cutting action takes place so that the depilatory could remain on the skin and permit it to stay on the skin the required period of time. The depilatory would then be removed in a conventional manner to enhance the hair removal process previously accomplished by the manual shaving through use of blades.

The invention should thereby provide a combination of mechanical shaving action and chemical depilatory action to effectively remove unwanted hair from the skin. These actions would be advantageously achieved through use of the same razor.

It is to be understood that features described with respect to certain embodiments may be used in other embodiments within the spirit of this invention.

What is claimed is:

1. A depilatory applicating razor comprising a handle, a cutting head mounted to said handle, at least one cutting blade in said cutting head for being disposed against an area of skin of a user to cut undesired hair from the skin of the user, a chamber in said handle containing a supply of applicating material, said applicating material being solely a depilatory substance, outlet passage means communicating with said depilatory supply chamber, and said outlet passage means having depilatory discharge means in said cutting head for discharging said depilatory substance against the skin of the user.

2. The razor of claim 1 wherein said razor is a manual razor.

3. The razor of claim 2 wherein said razor is a single edge razor.

4. The razor of claim 3 wherein said handle is hollow, and said supply chamber being a reservoir mounted in said hollow handle.

5. The razor of claim 4 wherein said depilatory discharge means is mounted for directing said depilatory substance generally toward said blade.

6. The razor of claim 5 including skin tensioning means on said cutting head for stretching the skin and exposing pores of the hair.

7. The razor of claim 6 wherein said depilatory substance discharge means is mounted for directing said depilatory substance generally at said skin tensioning means so that said depilatory substance is applied against the skin where the skin is stretched.

8. The razor of claim 7 including user actuating means on said handle for causing said depilatory substance to flow from said reservoir to said depilatory substance discharge means.

9. The razor of claim 7 including automatic actuating means for causing said depilatory substance to be discharged in response to a shaving action of said blade.

10. The razor of claim 4 wherein said cutting head is detachably mounted to said handle, and said reservoir being detachably mounted in said handle.

11. The razor of claim 1 wherein said razor is an electric razor.

12. A method of applying a depilatory substance while shaving with a razor, including the steps of applying a shaving aid material to an area of skin of a user, providing a supply of the depilatory substance in a hollow handle of the razor, removing undesired hair by shaving the hair with at least one blade in a cutting head mounted to the handle of the razor in a hair shaving operation, discharging the depilatory substance against the skin of the user through an outlet in the cutting head during the hair shaving operation, applying the depilatory substance to the skin independently of and subsequent to the shaving aid material application, permitting the depilatory substance to remain on the skin after the hair shaving operation, and wiping the depilatory substance off the skin.

13. The method of claim 12 including stretching the skin during the hair shaving operation, and applying the depilatory substance in pores of the hair where the skin is stretched.

14. The method of claim 13 including cutting the hair by the razor being a manually operated razor wherein the blade is stationarily mounted to a cutting head of the razor, and the shaving aid material is shaving cream.

15. The method of claim 14 wherein the blade is exposed from an edge of the cutting head, and applying the depilatory substance to the skin inwardly from the edge and behind the cutting blade so that the cutting blade does not remove the depilatory substance being simultaneously applied while the cutting blade is removing hair.

16. The method of claim 13 including cutting the hair by an electric razor, and the at least one blade comprises a plurality of electrically driven rotating blades.

17. The method of claim 12 including supplying the depilatory substance from a chamber in the hollow handle with the chamber containing solely the depilatory substance.

18. A depilatory applicating manual razor comprising a handle, a cutting head mounted to said handle, said cutting head having an edge adapted to be disposed toward an area of skin of a user, at least one cutting blade in said cutting head exposed at said edge for being disposed against the skin of the user to cut undesired hair from the skin of the user, said cutting blade being non-movably mounted to said cutting head to remain in a fixed position while cutting the hair in a shaving operation, a chamber in said handle containing a supply of depilatory substance, said chamber being devoid of any shaving cream, outlet passage means communicating with said depilatory supply chamber, said outlet passage means having an outlet end which is open and exposed directly to the skin of the user whereby said depilatory substance is permitted to flow in an unimpeded path from said supply chamber directly to the skin of the user, and said outlet passage means having depilatory discharge means in said cutting head for discharging said depilatory substance against the skin of the user inwardly of said edge and behind said cutting blade to permit said depilatory substance to remain on the skin of the user after said cutting blade has cut the undesired hair in the shaving operation.

19. The razor of claim 18 including a lotion incorporated in said depilatory substance.

20. The razor of claim 18 wherein said razor is a single edge razor.

21. The razor of claim 18 wherein said razor is a single edge razor, skin tensioning means on said cutting head for stretching the skin and exposing pores of the hair, and said depilatory discharge means directing said depilatory substance generally at said skin tensioning means so that said depilatory substance is applied against the skin where the skin is stretched.

22. The razor of claim 21 wherein said handle is hollow, and said depilatory supply chamber being a reservoir mounted in said hollow handle.

23. The razor of claim 22 including user actuating means on said handle for causing said depilatory substance to flow from said reservoir to said depilatory substance discharge means.

24. The razor of claim 22 wherein said cutting head is detachably mounted to said handle, and said reservoir being detachably mounted in said handle.

25. The razor of claim 18 including actuating means for causing said depilatory substance to be discharged in response to a shaving action of said blade.

26. The razor of claim 18 including a medicament incorporated in said depilatory substance.

* * * * *